US005438950A

United States Patent [19]

Rodrigues

[11] Patent Number: 5,438,950

[45] Date of Patent: Aug. 8, 1995

[54] DART BOARD SCORING SYSTEM

[76] Inventor: John M. Rodrigues, 36 Elaine Ave., Newbedford, Mass. 02745

[21] Appl. No.: 314,723

[22] Filed: Sep. 29, 1994

[51] Int. Cl.[6] ..... A63F 7/30

[52] U.S. Cl. ..... 116/222; 116/325; 235/90; 273/DIG. 26

[58] Field of Search ..... 116/222, 325, 326; 235/90; 273/DIG. 26

[56] References Cited

U.S. PATENT DOCUMENTS

| | | | |
|---|---|---|---|
| 2,640,457 | 6/1953 | Scordo et al. | 116/325 |
| 4,805,909 | 2/1989 | Roland | 273/148 R |
| 4,948,148 | 8/1990 | Danielson | 273/408 |
| 5,054,792 | 10/1991 | Danielson | 273/408 |
| 5,318,319 | 6/1994 | Jones et al. | 273/371 |

FOREIGN PATENT DOCUMENTS

| | | | |
|---|---|---|---|
| 123436 | 1/1947 | Australia | 116/222 |
| 15387 | of 1908 | United Kingdom | 116/325 |
| 451636 | 8/1936 | United Kingdom | 235/90 |

*Primary Examiner*—William A. Cuchlinski, Jr.
*Assistant Examiner*—Willie Morris Worth

[57] ABSTRACT

A dartboard scoring system for allowing players to keep score of a variety of dart games comprising a pegboard bearing indicia for dividing it into a plurality of team zones, each team zone bearing indicia dividing it into a matrix of scoring spaces, each scoring space bearing corresponding indicia indicative for scoring dart games, each scoring space further having a mounting hole formed thereon adapted for receiving a scoring marker; a chalkboard associated with the pegboard with the chalkboard adapted to be written upon with chalk for tallying and indicating a player's score during a dart game; and a plurality scoring markers, each securable in a mounting hole of the pegboard for indicating status of scoring during a dart game.

5 Claims, 4 Drawing Sheets

DART BOARD SCORING SYSTEM

BACKGROUND OF THE INVENTION

1. Field of the Invention

The present invention relates to a dart board scoring system and more particularly pertains to allowing players to keep score of a variety of dart games with a dart board scoring system.

2. Description of the Prior Art

The use of scoring systems is known in the prior art. More specifically, scoring systems heretofore devised and utilized for the purpose of keeping scores of dart games are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 298,922 to Hinkle discloses a scoreboard for the game of darts. U.S. Pat. No. 3,454,276 to Brenkert discloses a self-scoring dart game. U.S. Pat. No. 4,003,579 to Miscavage discloses a dart game scoreboard. U.S. Pat. No. 4,105,119 to Cowan discloses a dart game holder and score keeper. U.S. Pat. No. 5,054,792 to Danielson discloses a dart game scoring system.

While these devices fulfill their respective, particular objective and requirements, the aforementioned patents do not describe a dart board scoring system that allows player's to keep score of dart games like cricket and other dart games such as 301 and 501.

In this respect, the dart board scoring system according to the present invention substantially departs from the conventional concepts and designs of the prior art, and in doing so provides an apparatus primarily developed for the purpose of allowing players to keep score of a variety of dart games.

Therefore, it can be appreciated that there exists a continuing need for new and improved dart board scoring system which can be used for allowing players to keep score of a variety of dart games. In this regard, the present invention substantially fulfills this need.

SUMMARY OF THE INVENTION

In the view of the foregoing disadvantages inherent in the known types of scoring systems now present in the prior art, the present invention provides an improved dart board scoring system. As such, the general purpose of the present invention, which will be described subsequently in greater detail, is to provide a new and improved dart board scoring system and method which has all the advantages of the prior art and none of the disadvantages.

To attain this, the present invention essentially comprises, in combination, a rigid frame having opposed spaced horizontal upper and lower rails and opposed spaced vertical left and right rails coupled together end-to-end in a rectangular configuration to thereby define an interior. The frame further includes a cross rail perpendicularly coupled between the upper and lower rails for dividing the interior into a rectangular first holding space and a rectangular second holding space. A planar rectangular rigid pegboard is extended across and secured to the frame within the first holding space thereof. The pegboard bears indicia for dividing it into two team zones. Each team zone bears indicia for dividing it into a seven row by four column matrix of scoring spaces. Each scoring space of each adjacent row of each team zone bears corresponding indicia indicative of opening and closing score values during a game of cricket. Each scoring space further has a mounting hole formed thereon adapted for receiving a scoring marker. A planar rectangular rigid chalkboard is extended across and secured to the frame within the second holding space thereof. The chalkboard is adapted to be written upon with chalk for tallying and indicating a player's score during different dart games. A plurality of elongated rigid tee-shaped scoring markers is included with each scoring marker having a head end and a tip end with the tip end securable in a mounting hole of the pegboard for indicating status of opened, owned, and closed score values during a game of cricket. Lastly, a rigid elongated lip is included and coupled to the lower rail of the frame and extended outwards therefrom. The lip has a generally concave slot formed therealong with the lip holding scoring markers for use with the pegboard and adapted for holding pieces of chalk for use with the chalkboard.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved dart board scoring system which has all the advantages of the prior art scoring systems and none of the disadvantages.

It is another object of the present invention to provide a new and improved dart board scoring system which may be easily and efficiently manufactured and marketed.

It is a further object of the present invention to provide a new and improved dart board scoring system which is of durable and reliable construction.

An even further object of the present invention is to provide a new and improved dart board scoring system which is susceptible of a low cost of manufacture with regard to both materials and labor, and which accordingly is then susceptible of low prices of sale to the consuming public, thereby making such a dart board scoring system economically available to the buying public.

Still yet another object of the present invention is to provide a new and improved dart board scoring system which provides in the apparatuses and methods of the prior art some of the advantages thereof, while simultaneously overcoming some of the disadvantages normally associated therewith.

Even still another object of the present invention is to provide a new and improved dart board scoring system for allowing players to keep score of a variety of dart games.

Lastly, it is an object of the present invention to provide a new and improved dart board scoring system comprising a pegboard bearing indicia for dividing it into a plurality of team zones, each team zone bearing indicia dividing it into a matrix of scoring spaces, each scoring space bearing corresponding indicia indicative for scoring dart games, each scoring space further having a mounting hole formed thereon adapted for receiving a scoring marker; a chalkboard associated with the pegboard with the chalkboard adapted to be written upon with chalk for tallying and indicating a player's score during a dart game; and a plurality scoring markers, each securable in a mounting hole of the pegboard for indicating status of scoring during a dart game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
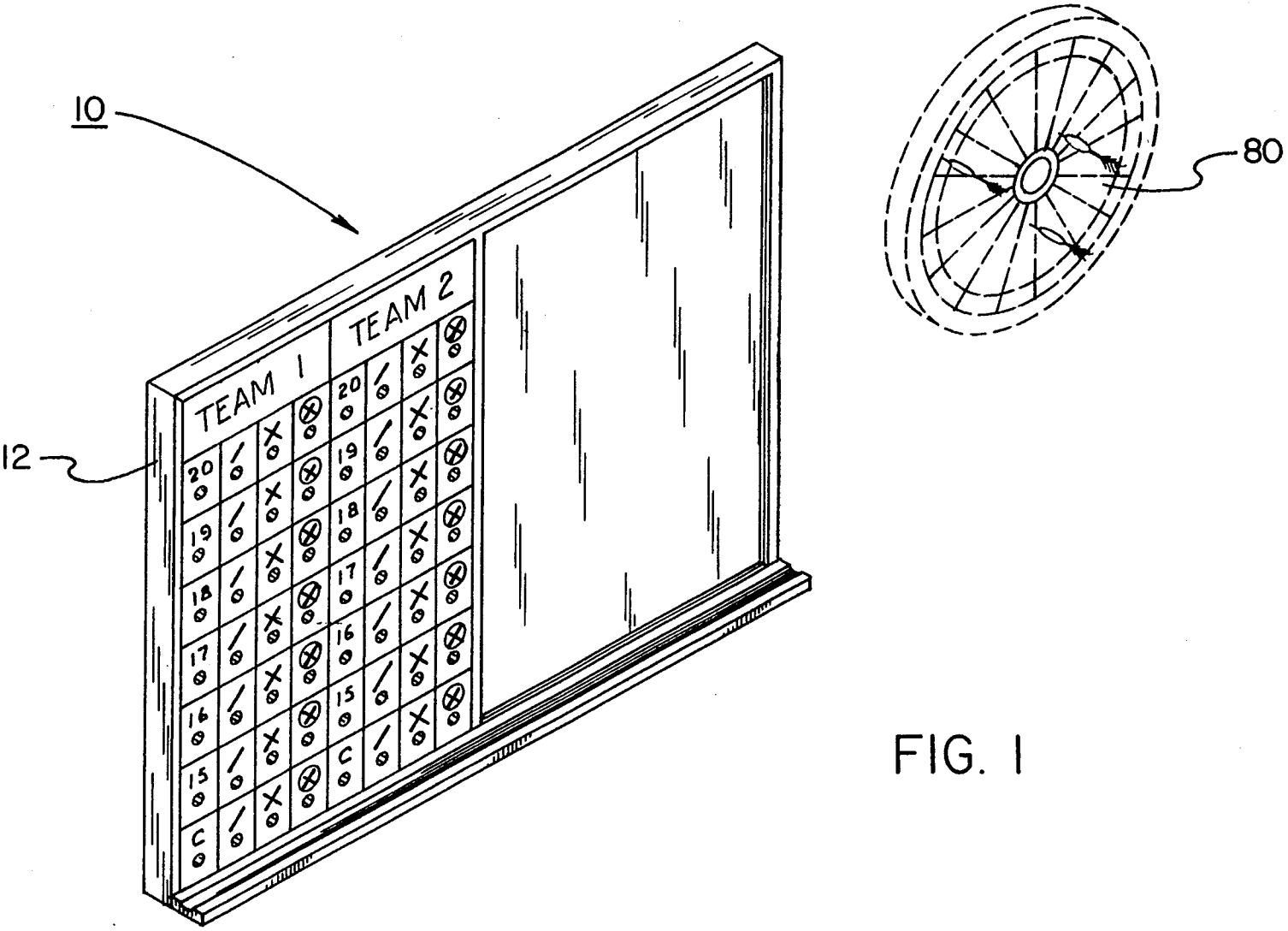
FIG. 1 is a perspective view of the preferred embodiment of the dart board scoring system constructed in accordance with the principles of the present invention in use with a dartboard.
Figure 3:
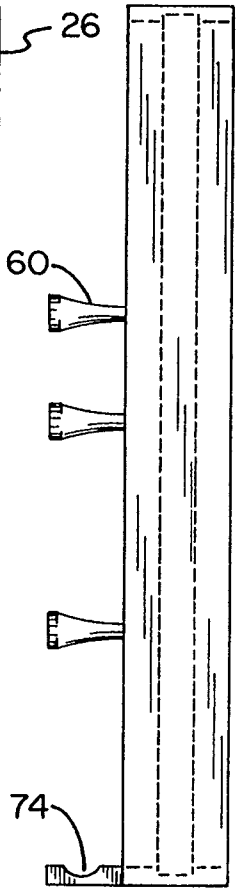
FIG. 3 is a side-elevational view of the present invention with a cricket score as shown in FIG. 2.
Figure 2:
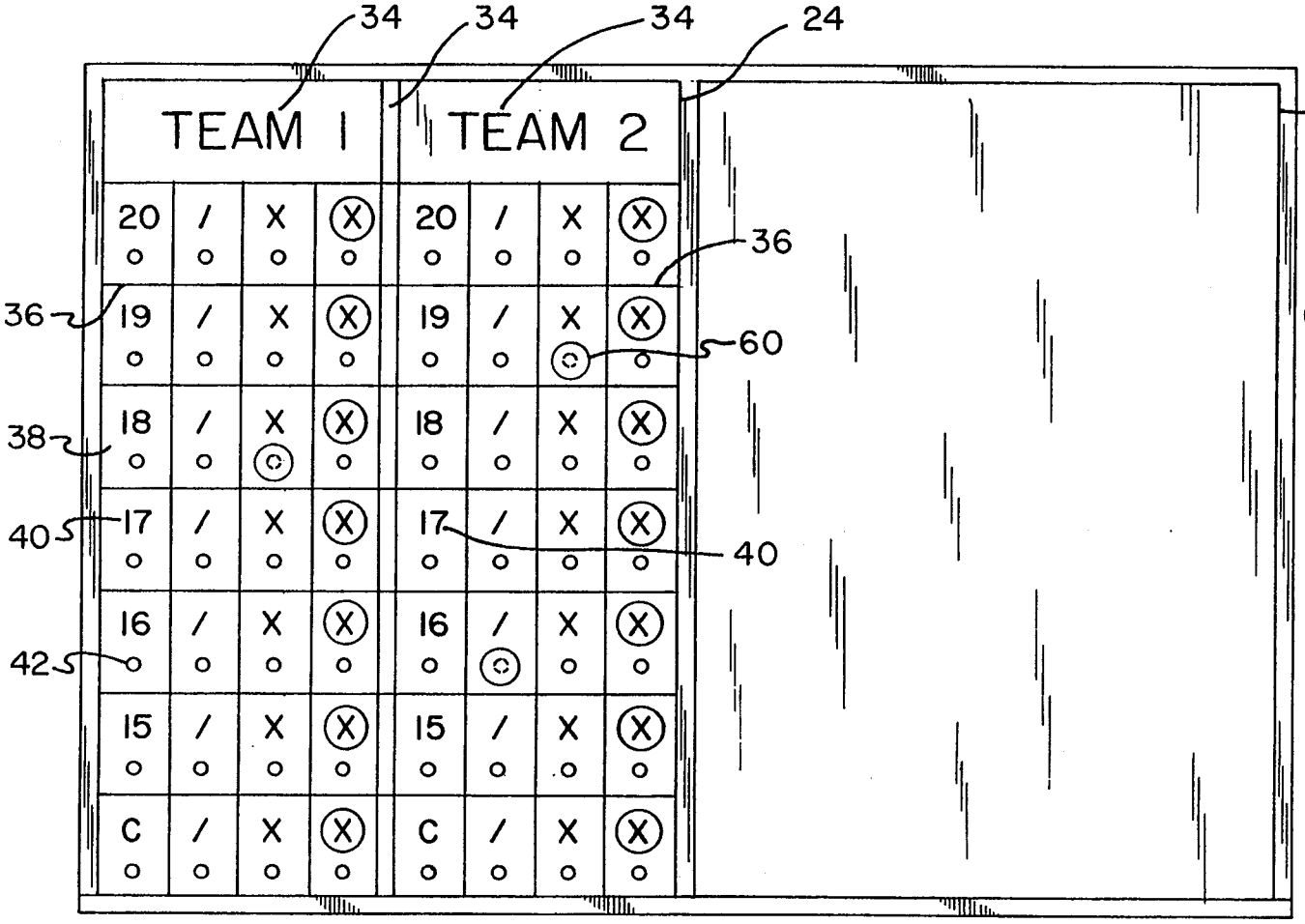
FIG. 2 is a plan view of the present invention with the markers thereof indicating a score during a game of cricket. As indicated by the pegboard, the score value of 16 for TEAM 2 needs two more hits before being opened for scoring by TEAM 2. Score value of 18 for TEAM 1 needs one more hit before being opened for scoring by TEAM 1. The score value of 19 for TEAM 2 needs one more hit before being opened for scoring by TEAM 2. Score values obtained by each team from opened score values may then be tallied upon the chalkboard.
Figure 4:
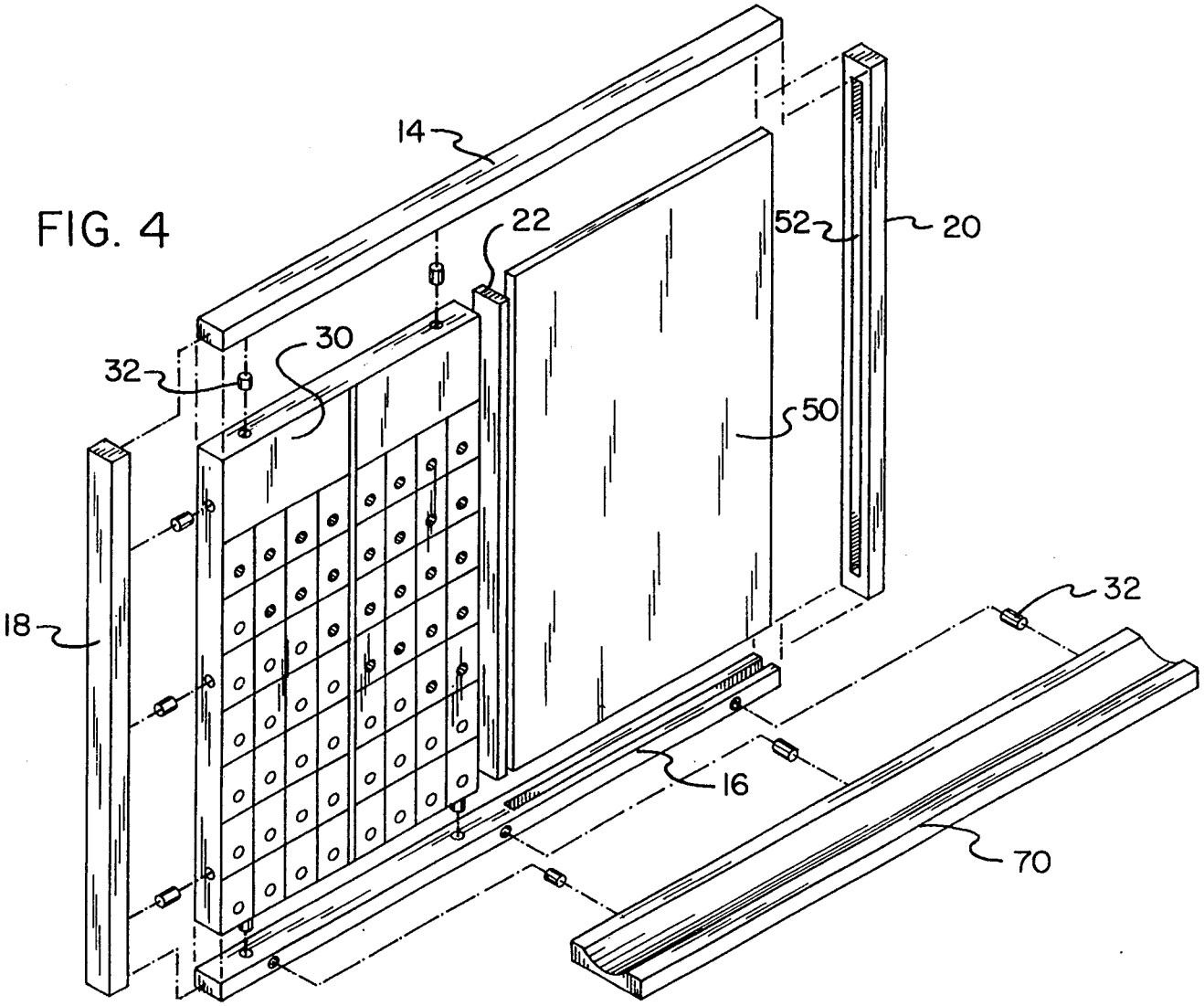
FIG. 4 is an exploded perspective view of the present invention.
Figure 5:
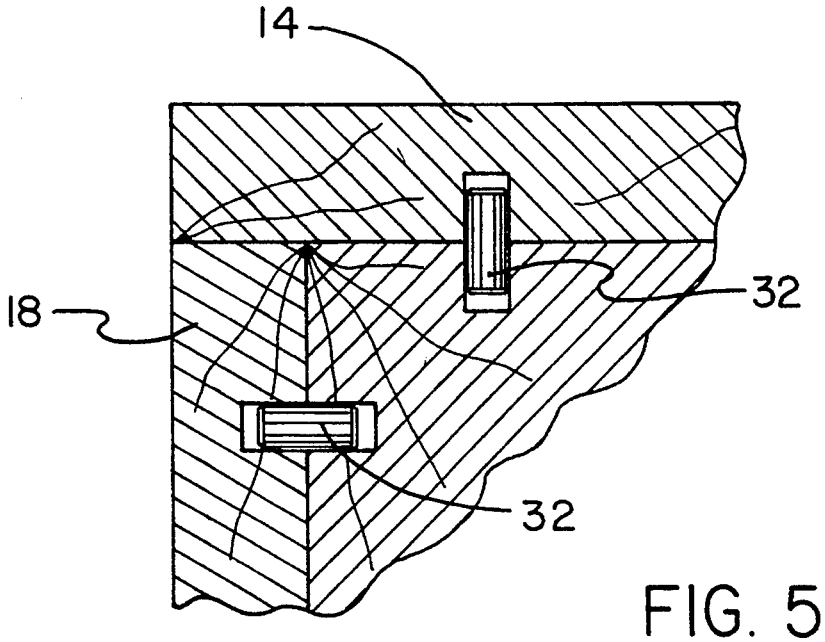
FIG. 5 is a cross-sectional view depicting the coupling between the pegboard and associated frame.
Figure 6:
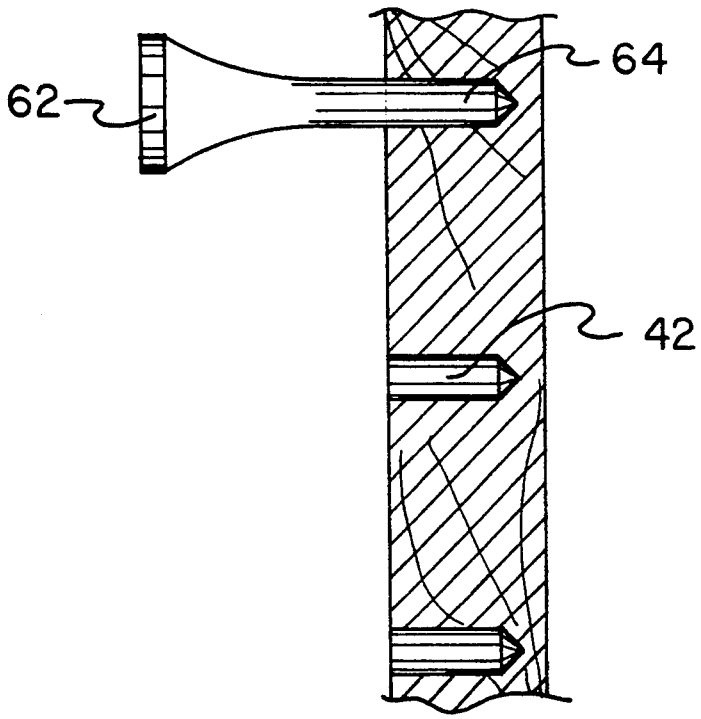
FIG. 6 is a cross-sectional view of the coupling between a marker and the pegboard.

With reference now to the drawings, and in particular, to FIG. 1 thereof, the preferred embodiment of the new and improved dart board scoring system embodying the principles and concepts of the present invention and generally designated by the reference number 10 will be described.

Specifically, the present invention essentially includes five major components. The major components are the frame, pegboard, chalkboard, scoring markers, and lip. These components are interrelated to provide the intended function.

More specifically, it will be noted in the various Figures that the first major component is the frame 12. The frame is formed of wood, plastic, or other such rigid material. It has opposed, spaced, and horizontal upper and lower rails 14, 16 and opposed, spaced, and vertical left and right rails 18, 20. These rails are coupled together end-to-end in a rectangular configuration to thereby define a hollow interior. The frame further includes a cross rail 22 perpendicularly coupled between the upper and lower rails for dividing the interior into a rectangular first holding space 24 and a rectangular second holding space 26.

The second major component is the pegboard 30. The pegboard is planar and rectangular in structure. It is formed of wood, plastic, or other such rigid material. The pegboard is planarly extended across and secured to the frame within the first holding space 24 with a plurality of pegs 32. The pegboard bears indicia 34 for dividing it into two team zones. Each team zone is appropriately labeled. Each team zone may represent a group of players or an individual player. Each team zone bears indicia 36 for dividing it into a 7 row by 4 column matrix of scoring spaces 38. Thus, each team zone has 28 scoring spaces. Each adjacent row of each team zone bears corresponding indicia 24 indicative of opening, owning, and closing score values during a game of cricket. With only the numbers 15 through 20 in play, each team tries to own these numbers by being the first to score on the number three times. Once a number is owned by a team, only that team may score on that number until the other team scores on the number three times an thereby closes the number to scoring. The score values of 15 through 20 and bullseye are represented in the first column of the matrix. The second column of each matrix represents a first registration and opening of a score value. The second column of each matrix represents a second registration and opening of a score value. The third column represents a third registration and opening of the score value with this column also representing the owning of a score value for scoring by a team or representing the closing of a score value by an opposing team. Each scoring space further includes a mounting hole 42 formed thereon. Each mounting hole is adapted for receiving a scoring marker for indicating a score and status of scoring.

The third major component is the chalkboard 50. The chalkboard is planar and rectangular in structure. It is formed of a rigid slate or similar material for writing upon with chalk. The chalkboard is plananlry extended across and secured to the frame within the holding space 26. A plurality of slots 52 are formed in the rails adjacent to the chalkboard for securing the chalkboard securely therein. The chalkboard is adapted to be written upon with chalk for tallying and indicating a player's score during different kinds of dart games such as cricket, and the games 301 through 901 (i.e. 301, 501, 601, etc). For example, in a game of cricket, the pegboard is used for maintaining the status of opened, owned, and closed score values while the chalkboard may be utilized for tallying the score values accumulated by different teams.

The fourth major component is the scoring markers 60. The present invention includes a plurality of scoring markers. Each scoring marker is elongated, rigid, and tee-shaped in structure. Each scoring marker has a head end 62 and a tip end 64. The tip end is securable in a mounting hole 42 of the pegboard for indicating status of open and closed score values during a game of cricket.

The fifth major component is the lip 70. The lip is elongated and rigid in structure. It is coupled to the lower rail 16 of the frame using a plurality of pegs 32. The lip is extended outwards from the frame. The lip has a generally concave slot 74 formed therealong. The slot is adapted for holding scoring markers for use with the pegboard and further adapted for holding pieces of chalk for use with the chalkboard. The present invention should be emplaced near a dartboard 80 for maximizing its ease of use.

The present invention allows players to keep score using either a large size chalkboard, or a dual team pegboard. It is constructed from attractively styled wood or plastic in a rectangular shape, with the chalkboard on the right hand side and the pegboard area to the left of it. The chalkboard is quite large, measuring $13\frac{1}{2}$ by 8 inches. The pegboard is divided into two team zones, each measuring $13\frac{1}{2}$ by 4 inches. The tops of these zones are marked TEAM 1 and TEAM 2. The base of the overall board has a small lip that can serve as a chalk and eraser storage area, as well as a scoring marker holder. The scoring markers offered with the board can be either specially designed for the board, or can simply be golf tees. The pegboard is further divided into scoring spaces, with markings from 20 to 15 in descending order, with an additional level for the bullseye. A hole is drilled beneath each stage of completion for that number.

In use, the scoring markers are inserted into the appropriate holes, based on how the players score on the dartboard. The chalkboard can be used as needed, serving as a supplemental score keeping tool. When the game is complete, the scoring markers are removed, and the chalkboard is erased. The present invention allows people to enjoy playing darts more by providing a very attractive and organized method for score keeping-an important part of any dart game. It also is pleasing to view, and should ameliorate the atmosphere of any bar or game room.

The chalkboard of the present invention may be used for scoring all types of dart games including the games of 301 and 501. The pegboard of the present invention may be used for scoring a game of cricket. A chalkboard may be used in combination with the pegboard for scoring a game of cricket while tallying points. The scoring markers of the present invention may be formed with conventional and commercially available golf tees or be formed with custom scoring markers. The present invention is adapted to be secured to a wall at a location such that the pegboard, chalkboard, and associated lip are readily accessible for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A dartboard scoring system for allowing players to keep score of a variety of dart games comprising, in combination:

a rigid frame having opposed spaced horizontal upper and lower rails and opposed spaced vertical left and right rails coupled together end-to-end in a rectangular configuration to thereby define an interior, the frame further including a cross rail perpendicularly coupled between the upper and lower rails for dividing the interior into a rectangular first holding space and a rectangular second holding space;

a planar rectangular rigid pegboard extended across and secured to the frame within the first holding space thereof, the pegboard bearing indicia for dividing it into two team zones, each team zone bearing indicia dividing it into a seven row by four column matrix of scoring spaces, each scoring space of each adjacent row of each team zone bearing corresponding indicia indicative of opening and closing score values during a game of cricket, each scoring space further having a mounting hole formed thereon adapted for receiving a scoring marker;

a planar rectangular rigid chalkboard extended across and secured to the frame within the second holding space thereof, the chalkboard adapted to be written upon with chalk for tallying and indicating a player's score during different dart games;

a plurality of elongated rigid tee-shaped scoring markers, each scoring marker having a head end and a tip end with the tip end securable in a mounting hole of the pegboard for indicating status of opened, owned, and closed score values during a game of cricket; and a rigid elongated lip coupled to the lower rail of the frame and extended outwards therefrom, the lip having a generally concave slot formed therealong with the lip holding scoring markers for use with the pegboard and adapted for holding pieces of chalk for use with the chalkboard.

2. A dartboard scoring system for allowing players to keep score of a variety of dart games comprising, in combination:

a pegboard bearing indicia for dividing it into a plurality of team zones, each team zone bearing indicia dividing it into a matrix of scoring spaces, each scoring space bearing corresponding indicia indicative for scoring dart games, each scoring space further having a mounting hole formed thereon adapted for receiving a scoring marker;

a chalkboard associated with the pegboard with the chalkboard adapted to be written upon with chalk for tallying and indicating a player's score during a dart game; and a plurality scoring markers, each securable in a mounting hole of the pegboard for indicating status of scoring during a dart game.

3. The dartboard scoring system as set forth in claim 2 further including:

a rigid frame having a first holding space and a second holding space formed therein; and wherein the pegboard is secured within the first holding space and the chalkboard is secured within the second holding space.

4. The dartboard scoring system as set forth in claim 3 further including holding means secured to the frame for holding markers and chalk adjacent to the pegboard and chalkboard for use.

5. The dartboard scoring system as set forth in claim 4 wherein the holding means is a rigid elongated lip secured directly below the pegboard and chalkboard.

* * * * *